US005574184A

United States Patent [19]

Wu et al.

[11] Patent Number: 5,574,184

[45] Date of Patent: Nov. 12, 1996

[54] ANTIWEAR AND ANTIOXIDANT ADDITIVES

[75] Inventors: Shi-Ming Wu, Newtown, Pa.; Andrew G. Horodysky, Cherry Hill, N.J.

[73] Assignee: Mobil Oil Corporation, Fairfax, Va.

[21] Appl. No.: 402,233

[22] Filed: Mar. 10, 1995

Related U.S. Application Data

[63] Continuation of Ser. No. 313,508, Sep. 26, 1994, Pat. No. 5,503,758, which is a continuation-in-part of Ser. No. 236, 867, May 2, 1994, Pat. No. 5,405,545, which is a continuation of Ser. No. 24,015, Mar. 2, 1993, abandoned.

[51] Int. Cl.[6] ..... C07C 315/00

[52] U.S. Cl. ..... 562/556; 560/147; 560/152; 564/192

[58] Field of Search ..... 560/147, 152; 562/556; 564/192

[56] References Cited

U.S. PATENT DOCUMENTS 4,327,111 4/1982 Sundeen ..... 564/192

OTHER PUBLICATIONS

Sax and Lewis, *Hawley's Condensed Chemical Dictionary*, 11th Edition (1987).

Dutta, J. Med. Chem., 33, pp. 2560–2568 (1990).

*Primary Examiner*—Michael L. Shippen

*Attorney, Agent, or Firm*—Ronald A. Bleeker; Dennis P. Santini; Jessica P. Sinnott

[57] ABSTRACT

A lubricant additive having antiwear and antioxidant properties is the reaction product of a sulfur-containing carboxylic acid and an etheramine, preferably 3,3'-thiodipropionic acid and N-isoeicosyloxypropyl-1,3-diaminopropane which is post reacted with an aliphatic alcohol, preferably oleyl alcohol, an aliphatic amine, preferably a tert-$C_{12}$ to $C_{14}$ amine and/or a trialkyl phosphite, preferably a tributylphosphite. The post-reaction product contains at least one ester, amide and/or phosphonate functional group.

3 Claims, No Drawings

ANTIWEAR AND ANTIOXIDANT ADDITIVES

CROSS-REFERENCE TO RELATED APPLICATIONS

This is a continuation of application Ser. No. 08/313,508, filed on Sep. 26, 1994, now U.S. Pat. No. 5,503,758, which is a continuation-in-part of U.S. application Ser. No. 08/236,867 filed on May 2, 1994, now U.S. Pat. No. 5,405,545, which is a continuation of U.S. Ser. No. 08/024,015, filed on Mar. 2, 1993 now abandoned, which are incorporated herein by reference in their entireties.

FIELD OF THE INVENTION

The invention is directed to an antiwear and antioxidant additive for a lubricant. More specifically, the invention is directed to the reaction product of a sulfur-containing carboxylic acid and an ether amine as well as a post-reaction product which contains phosphorus, ester and/or amide functional groups and lubricant compositions containing the post-reaction product.

BACKGROUND OF THE INVENTION

Direct frictional contact between relatively moving surfaces even in the presence of a lubricant can cause wear of the surfaces. The elimination of wear is an ideal goal which is approached by blending the lubricating media with additives which can reduce the wear. The most suitable antiwear additives are those that help to create and maintain a persistent film of lubricant even under severe conditions which would tend to deplete the lubricant film, such as high temperatures which thin the lubricant film and extreme pressures which squeeze the lubricant film away from the contacting surfaces.

Wear is a serious problem in internal combustion engines, diesel engines and gasoline engines in which metal parts are exposed to sliding, rolling and other types of forceful, frictional mechanical contract. Specific areas of wear occur in the gears, particularly hypoid gears which are under high loads,.piston rings and cylinders and bearings such as ball, sleeve and roller bearings. Since antiwear lubricants are made by incorporating antiwear additives into the lubricating fluid, compatibility of the additive is important. Compatibility is a problem encountered in the art because the antiwear functionality is usually polar which makes that portion insoluble in the lubricant. It is desirable to make antiwear additives which maintain the antiwear functionality while, at the same time, are soluble in the lubricant fluid.

Rust prevention is important in systems which are made from ferrous alloys, other than stainless steel, which are subject to rusting upon exposure to humid air. Mineral oils notoriously do not have good rust preventative properties and have; therefore, been mixed with appropriate antirust additives. While synthetic oils have better antirust properties they too can benefit from compatible antirust additives. Antirust additives are usually hydrophobic polar compounds which are adsorbed at the metal surface to shield the surface from exposure to corrosive compounds present in the environment. Known antirust additives of this kind include esters of phosphorus acids. Other antirust additives have the ability to neutralize the acidity of the lubricant as oxidation occurs. Antirust additives of this kind which are particularly useful under relatively high temperature conditions are nitrogenous compounds; e.g. alkyl amines and amides.

Oxidation of a lubricating oil occurs during ordinary, as well as severe, conditions and use. The properties of the oil change due to contamination of the oil and chemical changes in the oil molecules. Oxidation can lead to bearing corrosion, ring sticking, lacquer and sludge formation and excessive viscosity. Acid and peroxide oxidation products can promote corrosion of metal parts, particularly in bearings. The presence of an antioxidant can have a profound effect upon the rate of oxidation of the lubricating oil Known antioxidants include hydroxy compounds, such as phenols, nitrogen compounds such as amines and phosphorothioates, particularly zinc dithiophosphates.

Thiodipropionic acid has been described as an antioxidant additive in lubricant applications, see Hawley's *Condensed Chemical Dictionary,* (NY, 1987) at p. 1149.

Certain high molecular weight ether amines, such as N-hydrocarboxyloxypropyl-1, 3-diaminopropane, hydrocarboxylpropylamine and polyoxyalkyleneamine have been described as corrosion inhibitors for fuel and lubricant applications.

SUMMARY OF THE INVENTION

The invention is directed to an additive for a lubricant which has demonstrated antiwear and antioxidant properties. Additional properties which are expected are load-carrying and antirust activities.

The invention is directed to a reaction intermediate which is made by reacting a sulfur-containing carboxylic acid with an etheramine having the structural formula:

$$H_2N—R_1—O—R_2$$

where $R_1$ and $R_2$ are the same or different hydrocarbyl radicals and contain from about 1 to about 100, specifically, from about 1 to about 50, even more specifically, from about 2 to about 40 carbon atoms. Optionally, $R_1$ and $R_2$ also contain at least one oxygen atom and/or nitrogen atom such that $R_1$ and $R_2$ contain at least one ether and/or amine group. More specifically $R_1$ and $R_2$ contain at least one alkoxy, aminoalkyl carboxyl and or hydroxyl group ranging in molecular weight from 30 to 1500, specifically from 40 to 700.

The invention is also directed to a reaction product derived by post-reacting the above reaction intermediate with an aliphatic hydroxy compound, an aliphatic amine compound and/or a trialkylphosphite.

DETAILED DESCRIPTION OF THE INVENTION

The invention is directed to a thioamido carboxylic acid made by reacting a sulfur-containing carboxylic acid and an etheramine.

The sulfur-containing carboxylic acid is represented by the structural formula:

$$(R_3—O_2C)_a—\underset{\underset{(X)_c}{|}}{R_4}—S_n—\underset{\underset{(X)_d}{|}}{R_5}—(CO_2H)_b$$

where n=0–2, a=0–1, b=0–1, c=0–1, and d=0–1, X is H, SH or $CH_2CO_2H$; provided that when n=O, c+d=1 and X is SH and if n is not O, then X is not SH, and where $R_3$ is hydrogen or a hydrocarbyl radical which contains from about 1 to about 60 carbon atoms, usually, $R_3$ is hydrogen or a hydrocarbyl radical containing from about 1 to about 10 carbon atoms. Representative examples of suitable hydrocarbyl radicals include methyl, ethyl, propyl, butyl, pentyl, hexyl, octyl, decyl, dodecyl, hexadecyl and higher hydrocarbon groups, including isomers thereof such as isobutyl, sec-butyl, tert-butyl, isopentyl and isohexyl. Preferably $R_3$ is hydrogen or methyl. $R_4$ and $R_5$ are the same or different containing about 1 to about 30 carbon atoms, usually from about 1 to about 20 carbon atoms or $R_4$ is a hydrogen atom, typically, $R_4$ and $R_5$ are straight chain hydrocarbyl radicals and usually $R_4$ and $R_5$ are $C_1$ or $C_2$ or $R_4$ is a hydrogen atom. Specific examples of the contemplated sulfur-containing carboxylic acids include 3,3'-thiodipropionic acid, thiodiglycolic acid, thiodisuccinic acid, thioglycolic acid, thiolactic acid, thiomalic acid, dithiodiglycolic acid, dithiodipropionic acid, carbomethoxymercaptosuccinic acid, and the like.

The etheramine is, preferably a relatively high molecular weight etheramine, i.e. having a molecular weight ranging from about 60 to about 6000, preferably from about 85 to about 2000. Examples of suitable etheramines include N-hydrocarboxyloxypropyl-1,3-diaminopropane or hydrocarboxylpropylamine in which the hydrocarbyl group contains from about 1 to about 100 carbon atoms, typically from about 2 to about 40 carbon atoms or polyoxyalkyleneamines. Suitable amines have the structural formula:

$$R'\text{-}(CH_2CH(R'')O)_x\text{-}CH_2C(CH_3)HNH_2$$

where R' is a hydrocarbon group which can contain from about 1 to about 100 carbon atoms and R" is a hydrogen atom or a hydrocarbon group containing from about 1 to about 100 carbon atoms. Also suitable are polyether diamines based on polyalkylene oxide and are represented by the structural formula:

$$H_2N(A)_y\text{-}(O\text{-}A)_x\text{-}NH_2$$

where A is a straight chain or branched chain alkyl group containing from about 2 to about 10 carbon atoms, preferably from about 3 to about 6 carbon atoms, y is an integer ranging from 0 to 100, preferably 2 to 40, x is an integer ranging from 1 to 100, preferably 2 to 40; however, x+y must equal at least 1.

The sulfur-containing carboxylic acid and the ether amine are reacted in a mole ratio of acid to amine of 10 to 1, preferably from 1 to 1. The conditions of reaction include an elevated temperature of at least about 110° C. (230° F.), ranging from about 0° C. to 250° C. (32° F. to 482° F.) and typically from about 110° C. to 200° C. (230° F. to 392° F.). The pressure of the reactor is maintained at about one atmosphere, although this may vary with the temperature of reaction. The reaction mixture is maintained under these conditions from a period of time ranging from about 0.5 hour to 10 hours, preferably from about 1 hour to 4 hours.

Although not wishing to be bound by it, the resulting reaction intermediate, in one aspect of the invention, comprises the following structural formula:

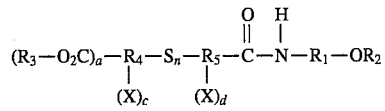

in which $R_1$–$R_5$, a, c, d, n and X are as defined above.

The above reaction intermediate is reacted to produce a product which contains phosphonate, ester and/or amide groups. Thus, in one aspect, the invention is directed to a reaction product in which an aliphatic hydroxy compound, an aliphatic amine or a trialkylphosphite is reacted with the above-described reaction intermediate.

Suitable aliphatic hydroxy compounds are represented by the structural formula:

$$R_6OH$$

in which $R_6$ is an aliphatic hydrocarbon group which contains about 1 to 100 carbon atoms, preferably from about 10 to 20 carbon atoms which can be straight chain or branched, slight branching may be preferred. For example, $R_6$ can be decene, dodecene or octadecene and isomers thereof.

Suitable aliphatic amine compounds are represented by the structural formula:

$$R_7NH_2$$

where $R_7$ is an aliphatic hydrocarbon group which contains from about 1 to 100 carbon atoms, preferably from about 10 to 20 carbon atoms which can be straight chain or branched. Specifically, the aliphatic amine is a tert-$C_{12}$ to $C_{14}$ amine.

Suitable trialkyl phosphites are represented by the structural formula:

$$(R_8O)_3P$$

where $R_8$ is an alkyl group which contains from about 1 to 60 carbon atoms, preferably from 2 to 8 carbon atoms, including methyl, ethyl, propyl and butyl.

To make the post-reaction product, the aliphatic alcohol, amine and/or phosphite are reacted with the reaction intermediate in proportion expressed in terms of mole ratio of intermediate to aliphatic alcohol, amine or phosphite of 1 to 1. The aliphatic alcohol and the aliphatic amine can be combined together with the intermediate in the same reaction mixture. The temperature of reaction should be maintained at about 230° F. (110° C.), ranging from about 0° C. to 250° C. (32° F. to 482° F.), preferably from about 110° C. to 200° C. (230° F. to 392° F.). The pressure of reaction is maintained at about one atmosphere, although this may vary depending upon the temperature of the reaction.

The post-reaction products contain at least one ester, amide and/or phosphonate functional group. The aliphatic alcohol, aliphatic amine and the phosphite react with the terminal carboxylic group of the intermediate to produce a final product which possesses at least one terminal group that provides excellent antiwear and antioxidant functionality. The sulfur-containing carboxylic acid starting material gives solubility properties to the product which facilitates the antiwear and antioxidant functionality contributed to the ester amide and/or phosphonate functional groups.

The post-reaction products are most effective when blended with lubricants in a concentration of about 0.01% to 10%, preferably, from 0.5% to 2% by weight of the total composition.

The contemplated lubricants are liquid oils in the form of either a mineral oil or synthetic oil or mixtures thereof. Also contemplated are greases in which any of the foregoing oils are employed as a base. Still further materials which it is believed would benefit from the reaction products of the present invention are fuels.

In general, the mineral oils, both paraffinic and naphthenic and mixtures thereof can be employed as a lubricating oil or as the grease vehicle. The lubricating oils can be of any suitable lubrication viscosity range, for example, from about 45 SSU at 100° F. to about 6000 SSU at 100° F., and preferably from about 50 to 250 SSU at 210° F. Viscosity indexes from about 95 to 130 are preferred. The average molecular weights of these oils can range from about 250 to 800.

Where the lubricant is employed as a grease, the lubricant is generally used in an amount sufficient to balance the total grease composition, after accounting for the desired quantity of the thickening agent, and other additive components included in the grease formulation. A wide variety of materials can be employed as thickening or gelling agents. These can include any of the conventional metal salts or soaps, such as calcium, or lithium stearates or hydroxystearates, which are dispersed in the lubricating vehicle in grease-forming quantities in an amount sufficient to impart to the resulting grease composition the desired consistency. Other thickening agents that can be employed in the grease formulation comprise the non-soap thickeners, such as surface-modified clays and silicas, aryl ureas, calcium complexes and similar materials. In general, grease thickeners can be employed which do not melt or dissolve when used at the required temperature within a particular environment; however, in all other respects, any material which is normally employed for thickening or gelling hydrocarbon fluids for forming greases can be used in the present invention.

Where synthetic oils, or synthetic oils employed as the vehicle for the grease are desired in preference to mineral oils, or in mixtures of mineral and synthetic oils, various synthetic oils may be used. Typical synthetic oils include polyisobutylenes, polybutenes, and other polyalphaolefins such as polydecenes, siloxanes and silicones (polysiloxanes) and other synthetic fluids.

The lubricating oils and greases contemplated for blending with the reaction product can also contain other additives generally employed in lubricating compositions such as co-corrosion inhibitors, detergents, co-extreme pressure agents, viscosity index improvers, co-friction reducers, co-antiwear agents and the like. Representative of these additives include, but are not limited to phenates, sulfonates, imides, heterocyclic compounds, polymeric acrylates, amines, amides, esters, sulfurized olefins, succinimides, succinate esters, metallic detergents containing calcium or magnesium, arylamines, hindered phenols and the like.

The additives are most effective when used in gear oils. Typical of such oils are automotive spiral-bevel and worm-gear axle oils which operate under extreme pressures, load and temperature conditions, hypoid gear oils operating under both high speed, low-torque and low-speed, high torque conditions.

Industrial lubrication applications which will benefit from the additives include circulation oils and steam turbine oils, gas turbine oils, for both heavy-duty gas turbines and aircraft gas turbines, way lubricants, mist oils and machine tool lubricants. Engine oils are also contemplated such as diesel engine oils, i.e., oils used in marine diesel engines, locomotives, power plants and high speed automotive diesel engines, gasoline burning engines, such as crankcase oils and compressor oils.

Functional fluids also benefit from the present additives. These fluids include automotive fluids such as automatic transmission fluids, power steering fluids and power brake fluids.

It is also desirable to employ the additive in greases, such as, automotive, industrial and aviation greases, and automobile chassis lubricants.

EXAMPLES

The following examples, which were actually conducted, represent a more specific description of the invention.

Example 1

Approximately 71.2 g (0.4 mol) of 3,3'-thiodipropionic acid, 150 ml of toluene and 165 g (0.4 mol) of N-isoeicosyloxypropyl-1,3-diaminopropane (under the tradename DA-25 obtained from Tomah Products of Exxon Chemical Company) were charged to a four-necked reactor. The mixture was heated to reflux for four hours before addition of oleyl alcohol (55 g, 0.2 mol) and 38.3 g (0.2 mol) of t-alkylamine (commercially obtained from Rohm & Haas Company as "Primene 81R"). The mixture was further reacted for four hours at reflux and then evaporated under reduced pressure at 130° C. to yield 310 g of viscous brown fluid.

Example 2

Under the reaction conditions as described in Example 1 with one exception: tributyl phosphite (75 g, 0.3 mol) was used instead of oleyl alcohol and Primene 81R).

EVALUATION OF THE PRODUCTS

Antiwear Properties

The ability of the oil containing the additives of the present invention to prevent the wearing down of metal parts under severe operating conditions was tested in the 4-Ball Wear Test. The results of the test are presented in Table 1. Following the standard ASTM testing procedure, the test was conducted in a device comprising four steel balls, three of which were in contact with each other in one plane in a fixed triangular position in a reservoir containing the test sample. The test sample was an 80% solvent paraffinic bright, 20% solvent paraffinic neutral mineral oil and the same oil containing about 1.0 wt % of the test additive. The fourth ball was above and in contact with the other three. The fourth ball was rotated at 2000 rpm while under an applied load of 60 kg, pressed against the other three balls, the pressure was applied by weight and lever arms. The test was conducted at 200° F. for 30 minutes.

The diameter of the scar on the three lower balls was measured with a low power microscope and the average diameter measured in two directions on each of the three lower balls was taken as a measure of the antiwear characteristics of the test composition. The table presents data showing the marked decrease in wear scar diameter obtained with respect to the test composition containing the product of the Examples.

TABLE 1

| Item | Four-Ball Test (60 kg load, 2000 rpm, 30 min., 200° F.) Wear Scar Diameter (mm) |
|---|---|
| Base Oil (80% solvent paraffinic bright, 20% solvent paraffinic neutral mineral oil) | 2.842 |
| 1% Example 1 in above base oil | 0.713 |
| 1% Example 2 in above base oil | 0.571 |

The results clearly show good antiwear activity by these post-reaction products.

Antioxidant Properties

The reaction products were blended in a concentration of 1 wt % in a 200 second, solvent refined paraffinic neutral mineral oil and evaluated for antioxidant performance in the Catalytic Oxidation Test at 325° F. for 40 hours. The results are presented in Table 2.

In the Catalytic Oxidation Test a volume of the test lubricant was subjected to a stream of air which was bubbled through the test composition at a rate of about 5 liters per hour for the specified number of hours and at the specified temperature. Present in the test composition were metals frequently found in engines, namely:

1) 15.5 square inches of a sand-blasted iron wire;

2) 0.78 square inches of a polished copper wire;

3) 0.87 square inches of a polished aluminum wire; and 4) 0.107 square inches of a polished lead surface.

The results of the test were presented in terms of change in kinematic viscosity (ΔKV), change in neutralization number (ΔTAN) and the presence of sludge. Essentially, the small change in ΔKV meant that the lubricant maintained its resistance to internal oxidative degradation under high temperatures, the small change in TAN indicated that the oil maintained its acidity level under oxidizing conditions.

TABLE 2

| Item | Catalytic Oxidation Text 40 hours at 325° F. Additive Conc. (wt %) | Change in Acid Number ΔTAN | Percent Change in Viscosity % ΔKV |
|---|---|---|---|
| Base Oil (200 second, solvent refined, paraffinic neutral, mineral oil) | — | 140.3 | 16.38 |
| Example 1 in above base oil | 1.0 | 69.2 | 8.16 |
| Example 2 in above base oil | 1.0 | 60.5 | 6.30 |

As shown above, the products of this invention show very good antioxidant activity as evidenced by control of increase in acidity and viscosity.

What is claimed is:

1. A reaction product made by reacting (1) a sulfur-containing carboxylic acid having the following structural formula:

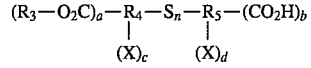

where n=0 to 2, a=0 to 1, b=0 to 1, c=0 to 1, d=0 to 1, and

X is H, SH or $CH_2CO_2H$;

provided that: if n=0, then c+d=1 and X is SH and if n is not 0, then X is not SH, and if a+b=0, then c+d≧1 and X is $CH_2CO_2H$, $R_3$ is a hydrogen atom or a hydrocarbyl radical which contains from 1 to 60 carbon atoms, $R_4$ and $R_5$ are the same or different hydrocarbyl radicals containing 1 to 30 carbon atoms and (2) an etheramine of structural formula:

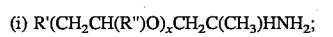

(i) $R'(CH_2CH(R'')O)_xCH_2C(CH_3)HNH_2$;

or an etherdiamine of structural formula:

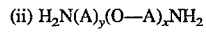

(ii) $H_2N(A)_y(O—A)_xNH_2$ where R' is a hydrocarbon group which contains from 1 to 100 carbon atoms, R" is a hydrogen atom or a hydrocarbon group containing from 1 to 100 carbon atoms, A is a straight chain or branched chain alkyl group containing from 2 to 10 carbon atoms, y is an integer ranging from 0 to 100 and x is an integer ranging from 1 to 100; the sulfur-containing carboxylic acid and the (i) etheramine or the (ii) etherdiamine is reacted in a mole ratio of acid to amine or diamine of 10 to 1 at a temperature ranging from about 0° to 250° C. at about one atmosphere pressure.

2. The reaction product of claim 1 in which A is a straight chain or branched chain alkyl group containing from 3 to 6 carbon atoms, y is an integer ranging from 2 to 40 and x is an integer ranging from 2 to 40.

3. The reaction product of claim 1 in which the sulfur containing carboxylic acid is 3,3'-thiodipropionic acid and the etherdiamine is N-isoeicosyloxypropyl-1,3-diaminopropane.

* * * * *